US008522879B2

(12) United States Patent
Lauderdale

(10) Patent No.: US 8,522,879 B2
(45) Date of Patent: Sep. 3, 2013

(54) METHOD AND APPARATUS FOR CONTROLLING FLUID FLOW INTO A BOREHOLE

(75) Inventor: Donald Powell Lauderdale, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 289 days.

(21) Appl. No.: 12/985,012

(22) Filed: Jan. 5, 2011

(65) Prior Publication Data

US 2012/0168175 A1 Jul. 5, 2012

(51) Int. Cl.
*E21B 34/00* (2006.01)

(52) U.S. Cl.
USPC ..... 166/334.1; 166/373

(58) Field of Classification Search
USPC . 166/373, 334.1, 319, 321, 325; 137/614.18, 137/614.2
See application file for complete search history.

(56) References Cited

U.S. PATENT DOCUMENTS

2006/0157257 A1 * 7/2006 Ross et al. ..... 166/386
2009/0211814 A1 * 8/2009 de Boer ..... 175/57

FOREIGN PATENT DOCUMENTS

WO WO 2009089622 * 7/2009

* cited by examiner

*Primary Examiner* — Kenneth L Thompson
*Assistant Examiner* — Taras P Bemko
(74) *Attorney, Agent, or Firm* — Cantor Colburn LLP

(57) ABSTRACT

In one aspect, a flow control apparatus for use in a borehole is provided. The apparatus includes a tubular body, a check valve sleeve and a check valve, wherein a change of a pressure inside the check valve sleeve causes the check valve to control fluid communication between the check valve sleeve and the borehole outside the tubular body.

20 Claims, 5 Drawing Sheets

METHOD AND APPARATUS FOR CONTROLLING FLUID FLOW INTO A BOREHOLE

BACKGROUND

To form a borehole in a formation, a drilling assembly (also referred to as the "bottom hole assembly" or the "BHA") carrying a drill bit at its bottom end is conveyed downhole. The borehole may be used to store fluids, such as CO2 sequestration, in the formation or obtain fluids, such as hydrocarbons or water, from one or more production zones in the formation. Several techniques may be employed to stimulate hydrocarbon production. For example, a plurality of boreholes (also "wellbores" or "wells"), such as a first and second borehole, may be formed in a formation. The first borehole is an injection borehole and the second borehole is a production borehole. A flow of pressurized fluids from the first borehole cause flow of formation fluids to the production borehole. Specifically, the fluid is flowed downhole within a tubular disposed in the first or injection borehole. One or more flow control apparatus, such as a valve, is located in the tubular to control the pressurized fluid flow into the formation. The pressurized fluid then causes an increased pressure within the formation resulting in flow of formation fluid into a producing string located in the second borehole. A surface fluid source, such as a pump, provides the pressurized injection fluid to each flow control apparatus downhole.

If the fluid source shuts down or malfunctions, a pressure differential occurs between the formation zone receiving the injected fluid and the fluid inside the tubular. Specifically, a pressure caused by injecting fluid into a zone of the formation is significantly higher than the hydrostatic pressure within the tubular. Communication of fluid across the pressure differential can cause crossflow from the high pressure zone to other lower pressure zones in the formation. The flow from the high pressure zone can cause flow of sand and debris into the tubular and lower pressure zones, inhibiting flow paths and causing damage to the tubular string. In addition flow of fluid from high pressure zone can cause a high pressure wave or water hammer of fluid to propagate uphole in the tubular. The high pressure wave can damage equipment within the tubular string and at the surface.

Devices for flow control of injection fluid from the tubular to the formation zone are controlled from the surface. A control signal to close the device may take several minutes to communicate from the surface. Due to the delayed control signal, the device remains open after a pump shut down, leading to communication of the pressure differential (between the formation and tubular) and resulting cross flow and pressure wave.

SUMMARY

In one aspect, a flow control apparatus for use in a borehole is provided. The apparatus includes a tubular body, a check valve sleeve and a check valve, wherein a change of a pressure inside the check valve sleeve causes the check valve to control fluid communication between the check valve sleeve and the borehole outside the tubular body.

In another aspect, a method for controlling fluid flow between a borehole and a tubular is provided, wherein the method includes directing a fluid downhole via a string to a tubular body. The method further includes increasing a first pressure of the fluid within the string, wherein increasing the first pressure to a selected level causes a check valve to move to an open position, wherein the selected level is greater than a second pressure of a borehole annulus outside the tubular. The method also includes directing the fluid from the string to the borehole annulus via the open check valve.

BRIEF DESCRIPTION OF THE DRAWINGS

The disclosure herein is best understood with reference to the accompanying figures in which like numerals have generally been assigned to like elements and in which.

DETAILED DESCRIPTION

Figure 1:
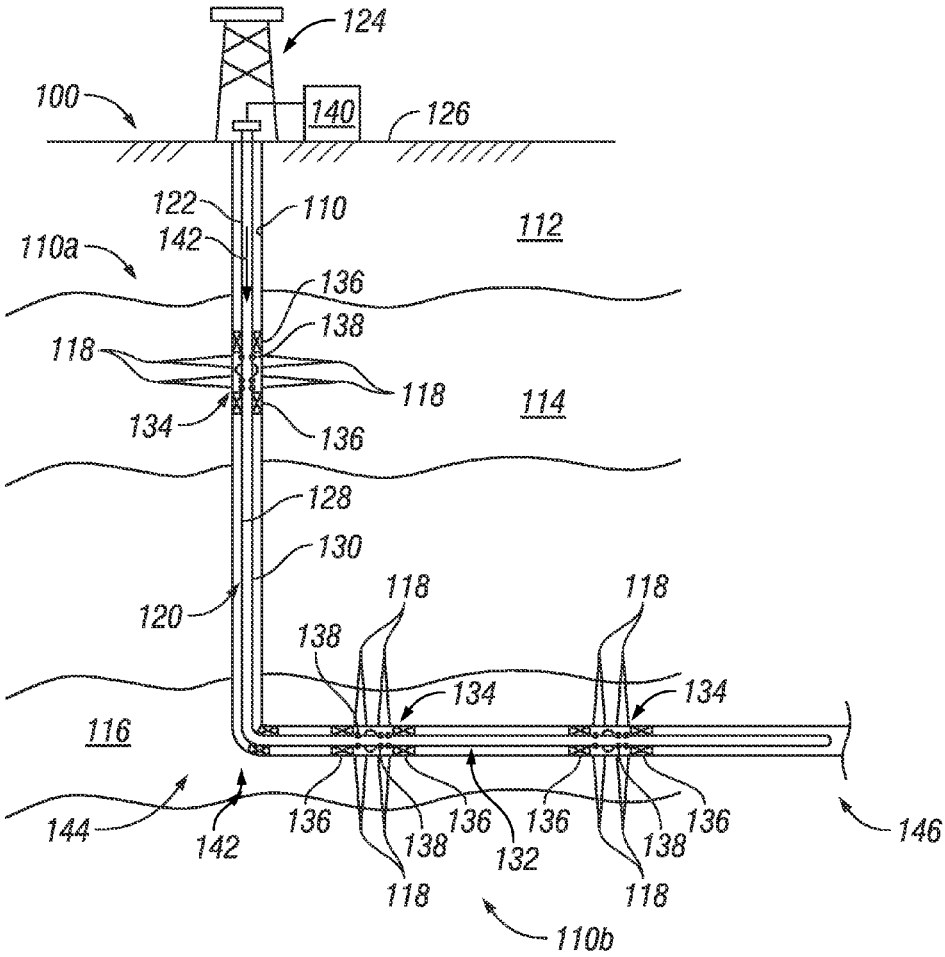
FIG. 1 is a schematic view of an embodiment of a system that includes a production tubular and injection apparatus.

Referring initially to FIG. 1, there is shown an exemplary borehole system 100 that includes a borehole 110 drilled through an earth formation 112 and into production zones or reservoirs 114 and 116. The borehole 110 is shown lined with an optional casing having a number of perforations 118 that penetrate and extend into the formation production zones 114 and 116 so that formation fluids or production fluids may flow from the production zones 114 and 116 into the borehole 110. The exemplary borehole 110 is shown to include a vertical section 110*a* and a substantially horizontal section 110*b*. The borehole 110 includes a string (or production tubular) 120 that includes a tubular (also referred to as the "tubular string" or "base pipe") 122 that extends downwardly from a wellhead 124 at surface 126 of the borehole 110. The string 120 defines an internal axial bore 128 along its length. An annulus 130 is defined between the string 120 and the borehole 110, which may be an open or cased borehole depending on the application.

The string 120 is shown to include a generally horizontal portion 132 that extends along the deviated leg or section 110*b* of the borehole 110. Injection assemblies 134 are positioned at selected locations along the string 120. Optionally, each injection assembly 134 may be isolated within the borehole 110 by a pair of packer devices 136. Although only two injection assemblies 134 are shown along the horizontal portion 132, a large number of such injection assemblies 134 may be arranged along the horizontal portion 132. Another injection assembly 134 is disposed in vertical section 110*a* to affect production from production zone 114. In addition, a packer 142 may be positioned near a heel 144 of the borehole 110, wherein element 146 refers to a toe of the borehole. Packer 142 isolates the horizontal portion 132, thereby enabling pressure manipulation to control fluid flow in borehole 110.

As depicted, each injection assembly 134 includes equipment configured to control fluid communication between a formation and a tubular, such as string 120. The exemplary injection assemblies 134 include one or more flow control apparatus or valves 138 to control flow of one or more injection fluids between the string 120 and production zones 114, 116. A fluid source 140 is located at the surface 126, wherein the fluid source 140 provides pressurized fluid via string 120 to the injection assemblies 134. Accordingly, each injection assembly 134 may provide fluid to one or more formation zone (114, 116) to induce formation fluid to flow to a second production string (not shown).

Injection fluids may include any suitable fluid used to cause a flow of formation fluid from formation zones (114, 116) to a production borehole and string. Further, injection fluids may include a fluid used to reduce or eliminate an impediment to fluid production, such as an acid. As used herein, the term "fluid" or "fluids" includes liquids, gases, hydrocarbons, multi-phase fluids, mixtures of two of more fluids, water and fluids injected from the surface, such as water and/or acid. Additionally, references to water should be construed to also include water-based fluids; e.g., brine, sea water or salt water.

In an embodiment, injection fluid, shown by arrow 142, flows from the surface 126 within string 120 (also referred to as "tubular" or "injection tubular") to injection assemblies 134. Flow control apparatus 138 (also referred to as "injection devices" or "valves") are positioned throughout the string 120 to distribute the fluid based on formation conditions and desired production. In one exemplary embodiment, the flow control apparatus 138 is configured to open to allow fluid to flow from tubular string 122 to borehole 110 when a fluid pressure inside the tubular string 122 reaches a first level or value. In addition, the flow control apparatus 138 is configured to close to shut off or restrict flow of the fluid from the tubular string 122 when the fluid pressure is lowered to a second level that is less than a pressure inside the borehole 110. Accordingly, the flow control apparatus 138 moves to a closed position shortly after a stoppage of pumping by the fluid source 140. The closed position prevents or restricts a pressure differential from being communicated between the tubular string 122 and borehole 110. Thus, flow of fluid from the production zone into the string 120 is restricted to reduce cross flow into other zones. As discussed in detail below, exemplary flow control apparatus 138 are controlled by a pressure level inside the tubular string 122, thereby improving performance of an injection process while reducing damage to equipment in the tubular string 122.

Figure 2:
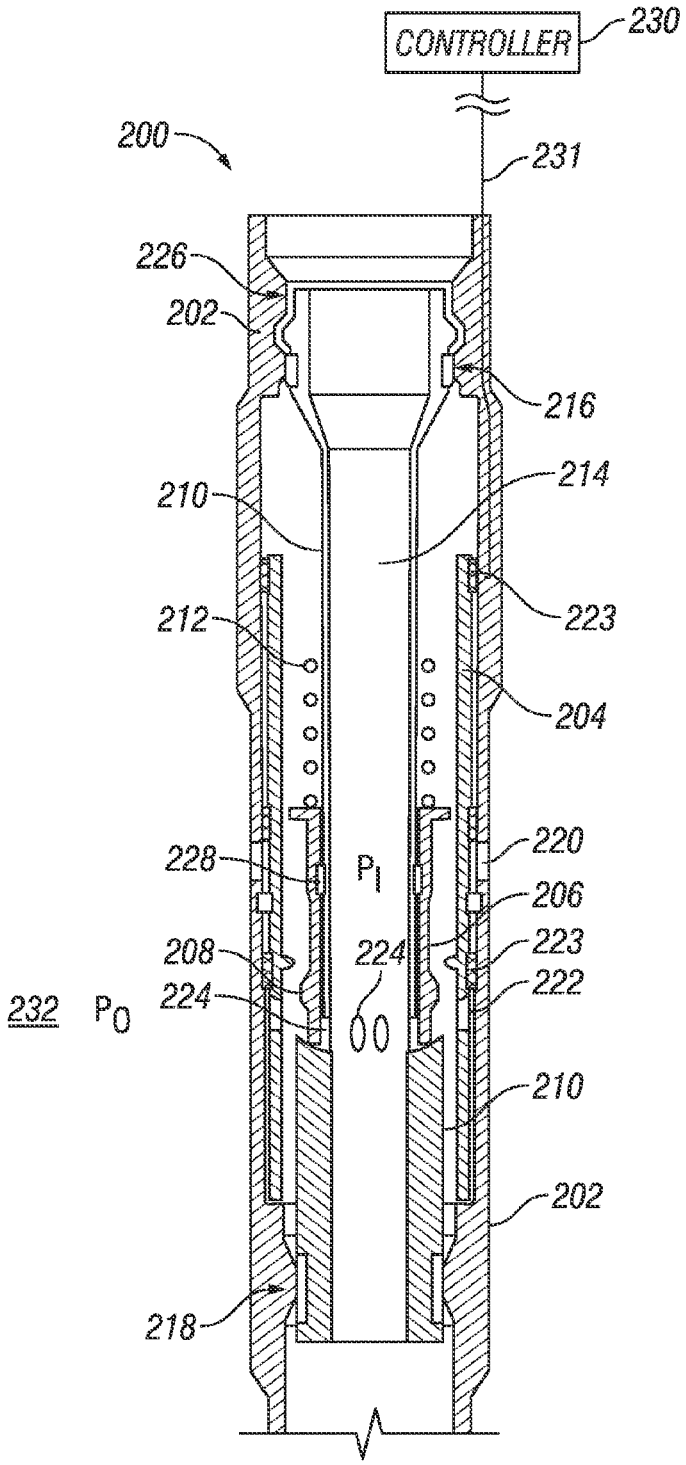
FIG. 2 is a side view of an exemplary flow control apparatus in a closed position.

FIG. 2 is a side sectional view of an exemplary flow control apparatus 200 to be placed downhole within the borehole 110 (FIG. 1). The flow control apparatus 200 includes a tubular body 202, an insert sleeve 204, a check valve 206 and a protrusion 208 located on the check valve 206. The flow control apparatus 200 also includes a check valve sleeve 210 and biasing member 212 coupled to the check valve 206. A flowbore 214 is in fluid communication with the surface 126 via tubular string 122 (FIG. 1). Upper seal 216 and lower seal 218 prevent fluid communication between the flowbore 214 and flow paths outside the check valve sleeve 210. In an embodiment, the protrusion 208 (also referred to as a "bean") is an annular protrusion from the check valve 206 that is configured to create a pressure drop as a fluid flows across the protrusion 208.

The depicted flow control apparatus 200 in a closed position, wherein the insert sleeve 204 and check valve are both in a closed position to restrict fluid communication between the flowbore 214 and a borehole annulus 232. Specifically, the insert sleeve 204 is positioned to block a passage 220 in the tubular body 202, wherein seals 223 restrict fluid flow inside the insert sleeve 204. In the closed position, a passage 222 in the insert sleeve 204 is not aligned with the passage 220. In addition, the check valve 206 blocks a passage 224 in the check valve sleeve 210. A seal 228 is located between the check valve 206 and check valve sleeve 208. The seal 228 restricts fluid flow between the flowbore 214 and outside the check valve sleeve 210. The flow control apparatus 200 may be in the closed position during run in or prior to production using an injection process. In the closed position, fluid communication is prevented or restricted between the flowbore 214 and the borehole annulus 232. The position of insert sleeve 204 is coupled to and controlled by a controller 230 via control lines 231. The controller 230 may be located in any suitable location, such as the surface 126 (FIG. 1). The position of check valve 206 is controlled by the biasing member 212 and the pressures of fluid outside (Po) and inside ($P_1$) the tubular body 202, as will be described in further detail below.

Figure 3:
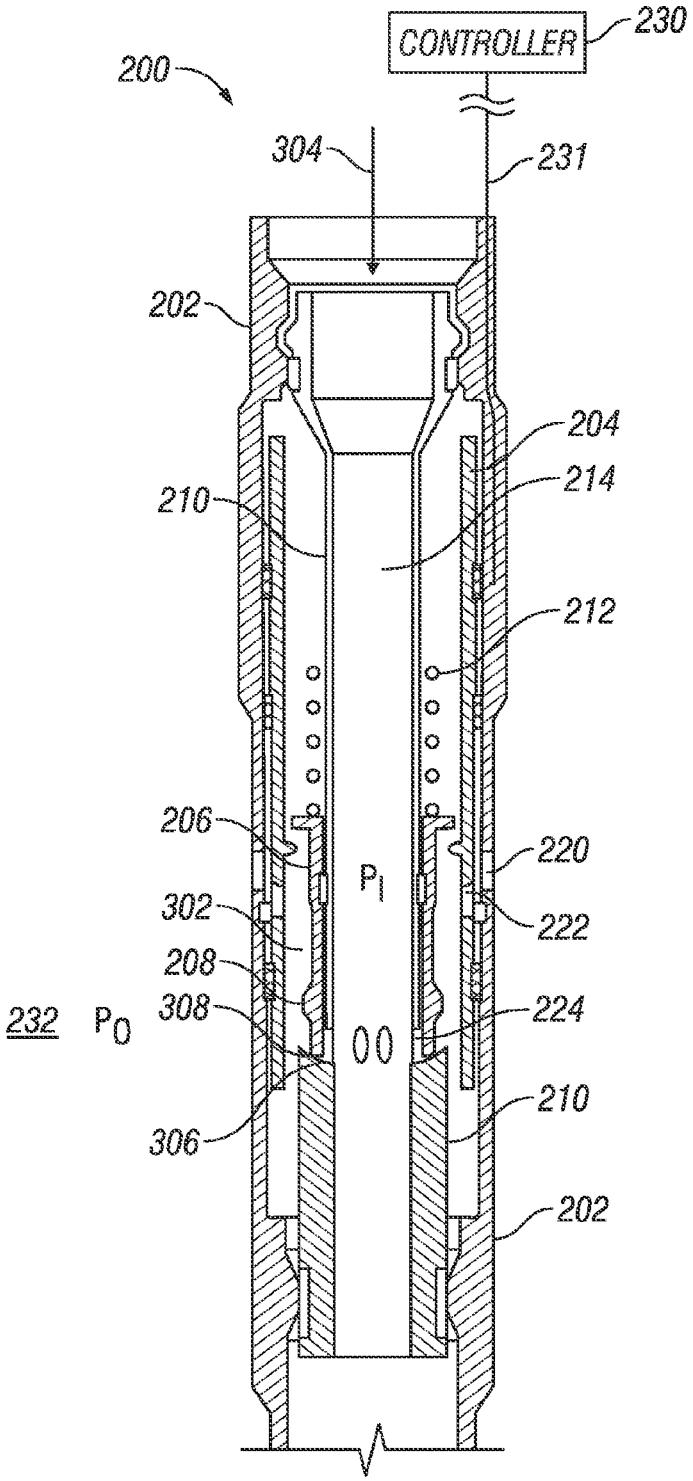
FIG. 3 is a side view of the exemplary flow control apparatus in a choked position.

FIG. 3 is a side sectional view of the exemplary flow control apparatus 200 in a choking position. The check valve sleeve 204 has been moved axially to a first open position, wherein the passages 220 and 222 are aligned to enable fluid communication between an annular cavity 302 and the borehole annulus 232. The annular cavity 302 is defined as substantially between the check valve sleeve 210 and insert sleeve 204. As depicted, fluid communication between the annular cavity 302 and the borehole annulus 232 causes the pressure in both areas to be equal ($P_O$). The check valve 206 (also referred to as a "poppet") remains in the closed position, thereby choking fluid flow between the flowbore 214 and borehole annulus 232. The biasing member 212 remains in an expanded state, wherein the expanded biasing member 212 provides a downward closing force on the check valve 206. Further, $P_O$ is a higher pressure than $P_I$, thereby causing an additional downward closing force on the check valve 206. It should be noted that the terms "blocked," "restricted," "closed" and "shut off" with respect to fluid communication and positions may include partially, substantially and completely restricting fluid communication, depending on application needs.

As discussed below, a fluid flow 304 provided by fluid source 140 (FIG. 1) may increase the pressure $P_I$ inside the flowbore 214 to cause an opening force that overcomes the closing force of the biasing member 212 and pressure $P_O$. As depicted, the check valve 206 sits on a seat 306 in the closed position, wherein an outer portion of the lower surface 308 of the check valve 206 contacts the seat 306. The remaining inner portion of surface 308 is exposed to the fluid and pressure $P_I$, wherein the increase in pressure creates an upward opening force on the surface 308 and check valve 206. As depicted, the controller 230 has moved the insert sleeve 204 axially to enable fluid communication between the borehole annulus 232 and annular cavity 302. Thus, the position of check valve 206 and resulting fluid communication between flowbore 214 and annulus 232 is controlled by manipulating the level of pressure $P_I$. The closed position of the check valve 206 prevents a pressure differential from being communicated between the flowbore 124 and in the borehole 110 reducing occurrences of cross-flow between zones.

Figure 4:
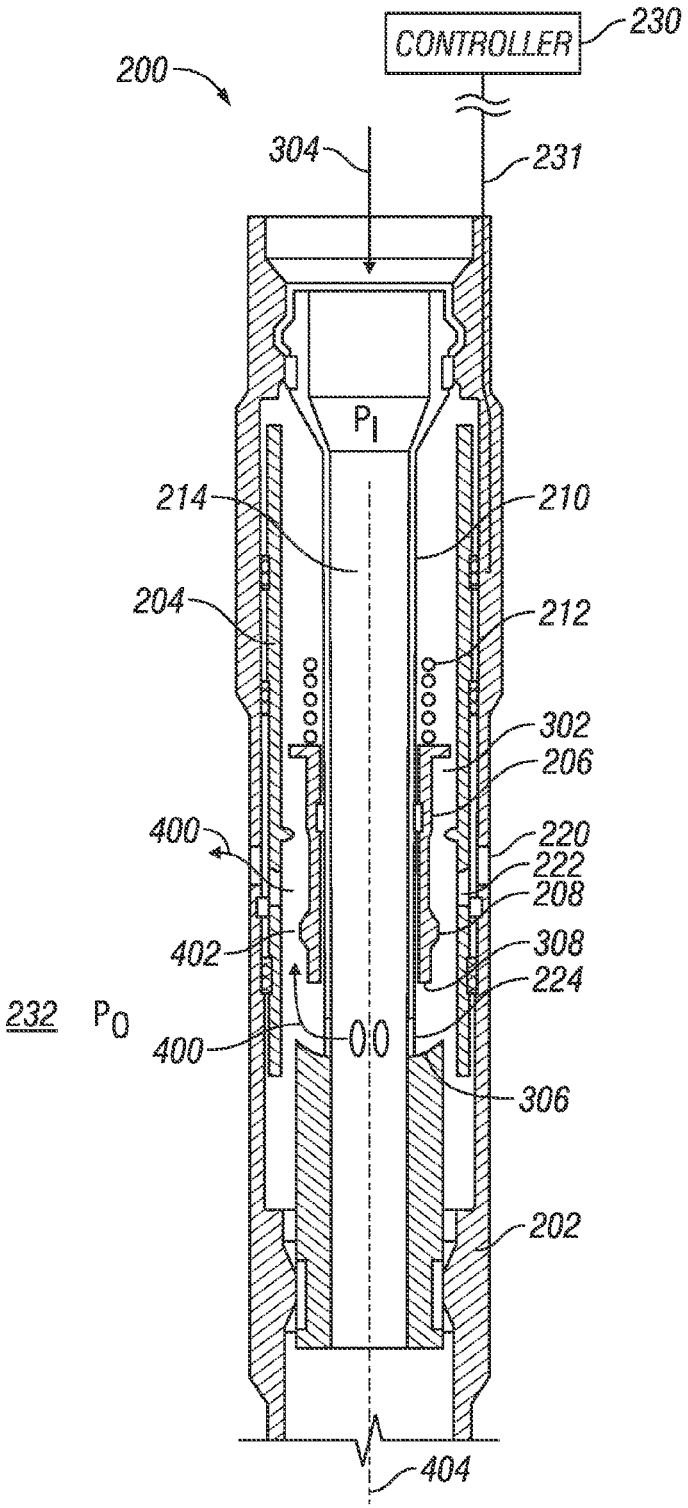
FIG. 4 is a side view of the exemplary flow control apparatus in an open position.

FIG. 4 is a side sectional view of the exemplary flow control apparatus 200 in an open injection position. The check valve sleeve 204 remains in the first open position, wherein the passages 220 and 222 are aligned to enable fluid communication between an annular cavity 302 and the borehole annulus 232. Further, the pressure $P_I$ has been increased to cause the check valve 206 to move open axially (along axis 404). Accordingly, the opening force caused by $P_I$ acts upon surface 308 to lift the check valve 206, overcoming the closing force of the biasing member 212 and pressure $P_O$ inside the annular cavity 302. As depicted, the biasing member 212 is compressed and the position of check valve 206 is open. Thus, a flow path 400 is provided within the flow control apparatus 200. In an embodiment, the flow path 400 allows fluid communication from the flowbore 214 to the borehole annulus 232, wherein the fluid flow 304 is pressurized to provide an injection of fluid into a formation zone. Flow of fluid along flow path 400 and across the protrusion 208 of the check valve 206 causes a pressure drop after flowing through passage 402, thereby stabilizing the open position of the check valve 206. Thus, the closed check valve 206 remains open until $P_I$ drops to a pressure level that is lower than $P_O$, wherein the closing forces of the biasing member 212 and pressure $P_O$ cause the check valve 206 to close. The check valve 206 thereby prevents fluid communication of the pressure differential ($P_O$ and $P_I$) between the borehole annulus 232 and flowbore 214. The pressure $P_I$ may drop due to a pump shut down or malfunction in fluid source 140 (FIG. 1)

Figure 5:
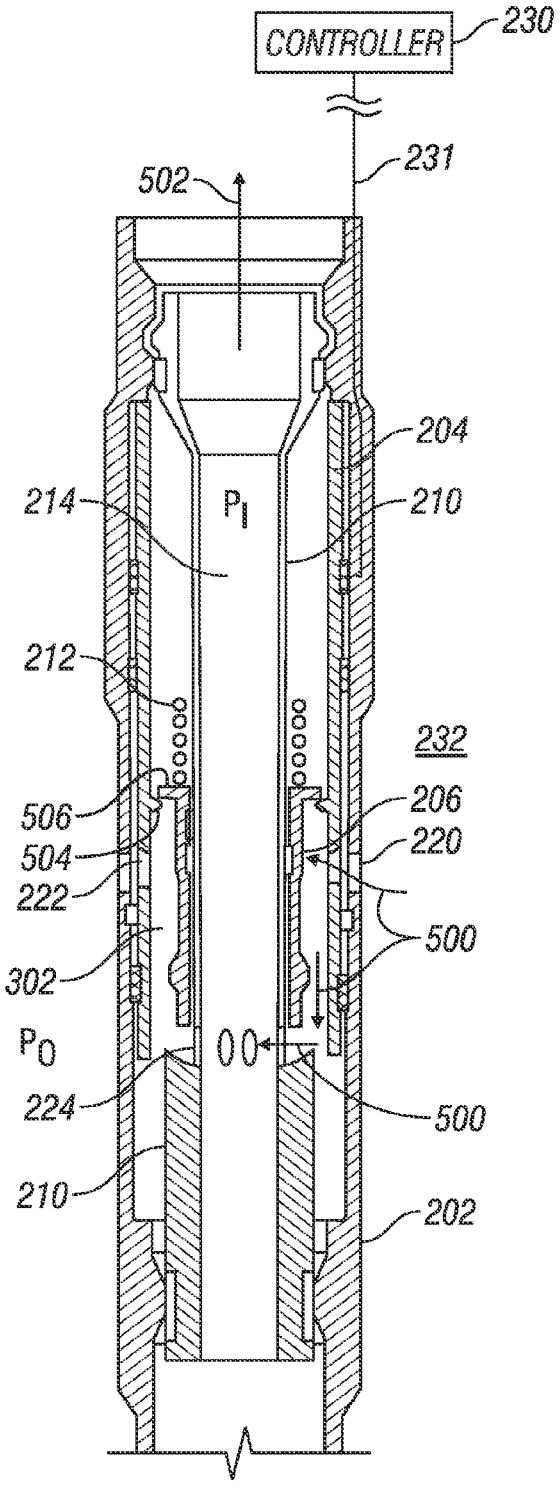
FIG. 5 is a side view of the exemplary flow control apparatus in a locked open position.

FIG. 5 is a side sectional view of the exemplary flow control apparatus 200 in a locked open position. The locked open position may be used to enable of fluid flow from the borehole annulus 232 into the flowbore 214, depicted by flow arrows 500 and 502, when pressure $P_I$ is less than or about equal to pressure $P_O$. In the embodiment, the insert sleeve 204 has been moved to a second open position, aligning passages 220 and 222. The controller 230 causes the insert sleeve 204 to move upward to a fully open position, wherein a protrusion 504 from the insert sleeve 204 engages and lifts a lip 506 of the check valve 206 as it moves upward. Thus, the locked open position is "locked" by the insert sleeve 204 in a fully open position.

In an exemplary embodiment, the locked open position enables fluid flow from the borehole annulus 232 to the flowbore 214 after an acid fluid has flowed into the borehole annulus 232 to break up debris impeding fluid flow into the formation. After acid injection, it is desirable to flow the acid and broken up debris to the surface to clean the borehole annulus 232, thereby enabling production to resume. Accordingly, the depicted locked open position allows fluid flow from the borehole annulus 232 into the flowbore 214 and uphole 502 to clean an area for future injection operations. In another embodiment, the locked position allows formation fluid to flow into the flowbore 214 and tubular string 122 (FIG. 1) to determine various flow parameters downhole, such as pressure and temperature. The determined parameters provide operators with information used to adjust production operations.

As shown in FIGS. 1-5, the flow control apparatus 200 provides an apparatus and method for controlling fluid flow from the tubular string 122 to the borehole annulus 232. Specifically, the position of the check valve 206 controls fluid communication between the borehole annulus 232 and the check valve sleeve 210, wherein the check valve 206 position is controlled by a fluid pressure level within the check valve sleeve 210. For example, when the fluid source 140 pumping system fails, the pressure within the tubular string 122 and check valve sleeve 210 drops or is reduced, thereby moving the check valve sleeve 210 closed and restricting fluid communication between the borehole annulus 232 and tubular string 122.

In an exemplary embodiment, the flow control apparatus 200 is run in at the closed position (FIG. 2), wherein the insert sleeve 204 is then moved to the open position by the controller 230 (FIG. 3). Then, a fluid pressure increase within the tubular string 122 and check valve sleeve 210 moves the check valve 206 to an open position (FIG. 4). The open position of the check valve 206 and the insert sleeve 204 provides fluid communication for injection fluid flow from the check valve sleeve 210 to the borehole annulus 232. When the pressure of the fluid inside the check valve sleeve 210 is decreased to a selected level below the borehole pressure, the check valve 206 is moved to a closed position, thereby restricting a flow path between the check valve sleeve 210 and borehole annulus 232. Thus, when the fluid source 140 (FIG. 1) shuts off, the pressure reduction within the check valve sleeve 210 prevents damage caused by communication of a pressure differential between the borehole annulus 232 and check valve sleeve 210.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

What is claimed is:

1. A flow control apparatus for use in a borehole, the apparatus comprising:

a tubular body extending from a string coupled to a fluid source;

an insert sleeve disposed within the tubular body to control fluid communication between the tubular body and the borehole;

a check valve sleeve at least partially disposed within the insert sleeve; and a check valve at least partially disposed within the insert sleeve, wherein a change of a pressure inside the check valve sleeve causes the check valve to control fluid communication between the check valve sleeve and the borehole outside the tubular body, wherein an open locked position of the insert sleeve comprises engagement of the insert sleeve with the check valve providing a flow path through the tubular body, the insert sleeve and the check valve sleeve.

2. The apparatus of claim 1, wherein the change of the pressure comprises an increase to a selected pressure greater than a borehole pressure.

3. The apparatus of claim 2, wherein the selected pressure causes an opening force greater than a closing force caused by a biasing member coupled to the check valve and the borehole pressure.

4. The apparatus of claim 1, comprising a biasing member coupled to the check valve, the biasing member configured to expand when the pressure is reduced, thereby restricting fluid communication between the check valve sleeve and the borehole.

5. The apparatus of claim 1, wherein control of fluid communication comprises axial movement of the insert sleeve, the axial movement of the insert sleeve being controlled by communication via a tubular string to a surface of the borehole.

6. The apparatus of claim 1, wherein the check valve comprises a contact surface that contacts a seat of the check valve sleeve when the check valve is in a closed position and wherein an increase in the pressure inside the check valve sleeve creates an opening force on the contact surface.

7. The apparatus of claim 1, wherein an open position of the insert sleeve comprises alignment of an insert sleeve passage and a tubular body passage.

8. The apparatus of claim 1, comprising a protrusion protruding into a flow path outside the check valve, thereby creating a pressure drop in the flow path to stabilize the check valve when in an open position.

9. The apparatus of claim 1, comprising a seat on the check valve sleeve configured to receive the check valve and expose a portion of a surface of an end of the check valve, wherein an opening force urges the portion of the surface in an opening direction.

10. The apparatus of claim 1, comprising a control line coupled to the insert sleeve configured to cause the insert sleeve to move to the open position and thereby lift the check valve to a fully open position, thereby enabling fluid flow from the borehole to the check valve sleeve and uphole.

11. A method for controlling fluid flow between a borehole and a tubular, the method comprising:

directing a fluid downhole via a string to a tubular body;

increasing a first pressure of the fluid within the string, wherein increasing the first pressure to a selected level causes a check valve to move to an open position, wherein the selected level is greater than a second pressure of a borehole annulus outside the tubular;

moving an insert sleeve to an open position, the insert sleeve being disposed within the tubular body, the check valve being at least partially disposed within the insert sleeve, the insert sleeve being moveable to an open locked position that comprises engagement of the insert sleeve with the check valve providing a flow path through the tubular body, the insert sleeve and a check valve sleeve disposed within the insert sleeve; and directing the fluid from the string to the borehole annulus via the open check valve.

12. The method of claim 11, comprising reducing the first pressure of the fluid within the string to move the check valve to a closed position, thereby restricting flow of the fluid to the borehole.

13. The method of claim 12, wherein reducing the first pressure comprises reducing the first pressure less than the second pressure causing a biasing member coupled to the check valve to expand, thereby causing axial movement of the check valve to the closed position.

14. The method of claim 11, wherein directing the fluid from the string comprises providing the first pressure of the fluid to cause a biasing member coupled to the check valve to compress, thereby causing axial movement of the check valve to the open position.

15. The method of claim 14, wherein directing the fluid from the string comprises directing the fluid from a check valve sleeve inside the check valve, thereby providing a opening force on an end surface of the check valve from the first pressure that is greater than a closing force caused by the second pressure and the biasing member.

16. A flow control apparatus to be used in a borehole, the apparatus comprising:

a tubular body to be coupled to a tubular string and disposed in the borehole, the tubular string being coupled to a fluid source;

an insert sleeve disposed within the tubular body to control fluid communication between the tubular body and the borehole;

a check valve sleeve in fluid communication with the tubular string, the check valve sleeve being at least partially disposed within the insert sleeve; and a check valve disposed between the check valve sleeve and the tubular body and at least partially disposed within the insert sleeve, wherein a first pressure inside the check valve sleeve controls a position of the check valve relative to a passage in the check valve sleeve and thereby controls fluid communication between the check valve sleeve and an annulus in the borehole, wherein an open locked position of the insert sleeve comprises engagement of the insert sleeve with the check valve providing a flow path through the tubular body, the insert sleeve and the check valve sleeve.

17. The apparatus of claim 16, comprising a moveable insert sleeve positioned adjacent the tubular body, wherein a passage in the insert sleeve and a passage in the tubular body are aligned to enable fluid communication between the annulus in the borehole and an annular cavity between the tubular body and check valve sleeve.

18. The apparatus of claim 16, comprising a fluid source at a surface of the borehole that controls the first pressure, wherein an increase in the first pressure to a level greater than a second pressure in the annulus of the borehole causes the check valve to allow fluid communication between the annulus of the borehole and the check valve sleeve.

19. The apparatus of claim 16, wherein a reduction in the first pressure to a selected level less than a second pressure in the annulus of the borehole causes the check valve to restrict fluid communication between the annulus of the borehole and the check valve sleeve.

20. A flow control apparatus for use in a borehole, the apparatus comprising:

a tubular body extending from a string coupled to a fluid source;

an insert sleeve disposed within the tubular body to control fluid communication between the tubular body and the borehole;

a check valve sleeve at least partially disposed within the insert sleeve;

a check valve at least partially disposed within the insert sleeve, wherein a change of a pressure inside the check valve sleeve causes the check valve to control fluid communication between the check valve sleeve and the borehole outside the tubular body; and a control line coupled to the insert sleeve configured to cause the insert sleeve to move to the open position and thereby lift the check valve to a fully open position, thereby enabling fluid flow from the borehole to the check valve sleeve and uphole.

* * * * *